United States Patent [19]

Heath

[11] 4,152,789

[45] May 8, 1979

[54] SHOWER STALL ENCLOSURE

[75] Inventor: Frederick G. Heath, Louisville, Ky.

[73] Assignee: VBM Corporation, Louisville, Ky.

[21] Appl. No.: 854,804

[22] Filed: Nov. 25, 1977

[51] Int. Cl.[2] ..... A47K 3/22

[52] U.S. Cl. ..... 4/146; 4/145

[58] Field of Search ..... 4/145, 146, 147, 148, 4/149, 152–155, 160, 164; 52/264, 220, 221, 34, 35

[56] References Cited

U.S. PATENT DOCUMENTS

| | | | |
|---|---|---|---|
| 1,998,234 | 4/1935 | Grimes | 52/220 |
| 3,293,664 | 12/1966 | Coons | 4/145 |
| 3,473,278 | 10/1969 | Gossen | 52/220 |
| 3,751,737 | 8/1973 | Mustee | 4/146 |
| 3,757,358 | 9/1973 | Chisholm | 4/146 |
| 3,895,398 | 7/1975 | Mustee | 4/145 |
| 3,940,806 | 3/1976 | Mustee | 4/146 |

*Primary Examiner*—Henry K. Artis

*Attorney, Agent, or Firm*—Maurice L. Miller, Jr.

[57] ABSTRACT

A shower stall featuring wall panels joined together to form a three-sided enclosure and a pair of rigid elongated hand rail members attached to opposing ones of the wall panels and extending rearward within the stall to connect to the rear wall panel. An elongated brace is attached to the outside surface of the rear wall panel and extends at least partially across the same to interconnect through the rear wall panel to each of the hand rail members.

14 Claims, 8 Drawing Figures

64
60D
65
64
60C
19
62
54
16
60B
60A
18
2
42
10
40
38
14
22
26
2
26
20
52
30
24
36
66
66
28
58
12
66
70
69
32
56
34

1

SHOWER STALL ENCLOSURE

BACKGROUND OF THE INVENTION

This invention relates generally to shower stall cabinets or enclosures and more specifically to free-standing or self-supporting shower stall enclosures employing flexible wall panels with rigidifying means therefor.

Shower stall enclosures having lightweight flexible wall panels constructed of relatively thin gauge metal have long been known and used in the prior art. Wall panels defining such enclosures were typically rigidified by means of a rectangular metal drain base into which the bottom edges of the panels were inserted. In addition, elongated metal angle members were disposed along the top edges of the panels and across the doorway and secured together at their adjacent ends, and a metal strap was disposed along the panels either within or outside of the stall at a level intermediate the base and angle members. A difficulty encountered with these early prior art enclosures was their tendency to corrode wih long term exposure to water and steam.

Such problems with corrosion were thereafter substantially overcome in the prior art by constructing lightweight flexible wall panels of non-corrosive plastic materials such as, for example, fiberglass reinforced polyester resin, polypropylene, ABS, and the like. See for example U.S. Pat. No. 3,757,358 issued to J. E. Chisholm, et al. on Sept. 11, 1973 which discloses a free-standing shower stall constructed entirely of plastic and consisting of a one-piece three-sided wall panel disposed within a molded rectangular base or receptor and further reinforced at the top of the wall panel by means of a header and wall surrounding support. Another free-standing flexible walled shower stall is disclosed in U.S. Pat. No. 3,751,737 issued to B. E. Mustee on Aug. 14, 1973 consisting of either a one-piece three-sided plastic wall panel having either a "live hinge" formed of plastic along the two vertical rear corners thereof or three separate plastic wall panels joined together at the two rear corners by strips of flexible waterproof plastic tape, also to form hinges. In either case, the latter patent discloses the rigidification of such panels by insertion of their bottom edges into a molded plastic base, joinder of their top edges by means of metal angle members, and by disposition of a rigid U-shaped hand rail within the enclosure so as to bridge the two inside rear corners of the stall and extend laterally along adjacent wall panels to interconnect the same together.

A difficulty that has been encountered with the latter prior art shower stall is the necessity of employing a bent hand rail member with a resulting relatively low strength-to-weight ratio. Another difficulty encountered is the taking up of valuable space within the shower stall through use of a hand rail element which is more extensive than necessary in order to provide adequate and convenient hand holding means.

By means of the present invention, a useful self-supporting shower stall enclosure is provided having highly rigidified flexible wall panels which substantially overcomes these and other prior art difficulties.

SUMMARY OF THE INVENTION

Briefly, it is an object of the present invention to provide a shower stall having wall panels joined together to form a three-sided enclosure having two right angular rear corners and defining a frontal access opening. A pair of rigid elongated hand rail members, attached to and extending at least partially along opposing broad surfaces of opposite ones of the wall panels, connect with a rear one of the wall panels opposite the access opening. An elongated brace is attached to and extends at least partially across the rear one of the wall panels outside of the enclosure, the brace being connected through the rear one of the wall panels to each of the hand rail members.

Additional objects, features and advantages of the present invention will become apparent to those skilled in the art from the following detailed description and attached drawings upon which by way of example, only the preferred embodiment of the subject invention are illustrated.

DESCRIPTION OF THE PREFERRED EMBODIMENTS

Figure 1:
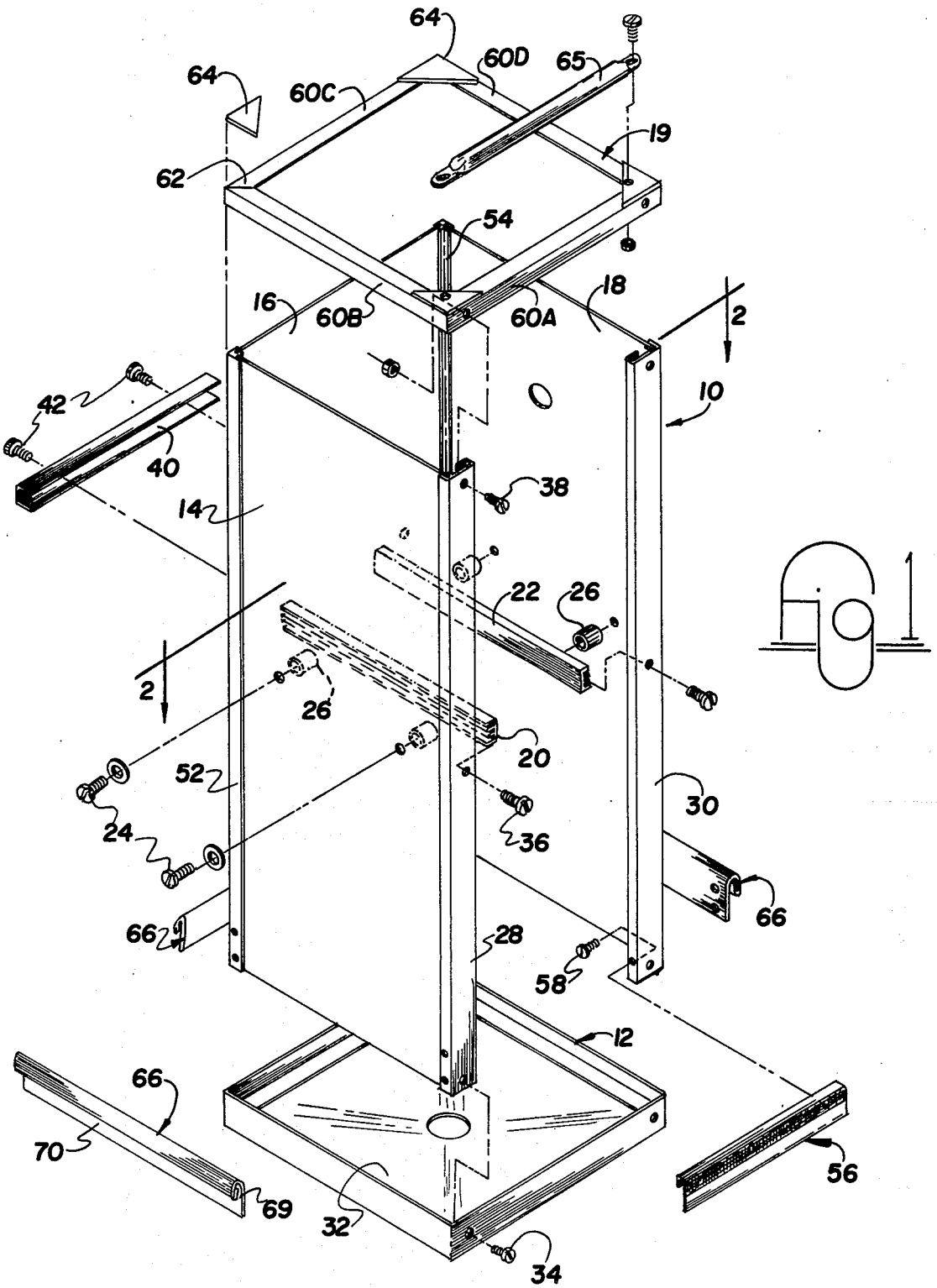
FIG. 1 shows an exploded oblique projection of a shower stall and associated components illustrating one preferred embodiment of the invention.

Referring now to the figures, there is shown, in a preferred embodiment of the invention, a shower stall 10 including a drain base 12, a series of rectangular wall panels 14, 16 and 18 and a wall panel supporting frame 19.

The panels 14, 16 and 18 are preferably formed of a lightweight waterproof sheet material such as relatively thin gauge non-corrosive metal or a plastic such as fiberglass reinforced polyester resin, polypropylene, polyethylene, ABS or the like. A pair of elongated hand rail members 20 and 22 are attached by means of suitable threaded fasteners 24 disposed through cylindrical spacers 26 to opposing wall panels 14 and 18. The members 20 and 22 extend horizontally between a pair of door jambs 28 and 30 and the rear panel 16 at a convenient height above a floor 32 of the base 12. The jambs 28 and 30 are preferably formed from an extruded aluminum alloy and are attached to the base 12 by means of threaded fasteners 34, to the forward ends of the hand rail members 20 and 22 by means of threaded fasteners 36, and to the support frame 19 by means of threaded fasteners 38.

Figure 3:
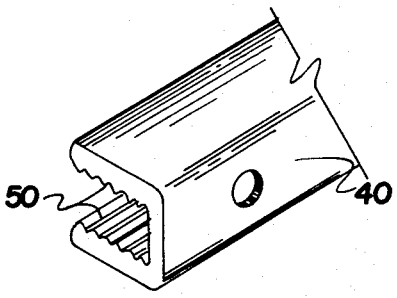
FIG. 3 shows a fragmented oblique projection of a brace as used in association with the shower stall of FIGS. 1-2.
Figure 4:
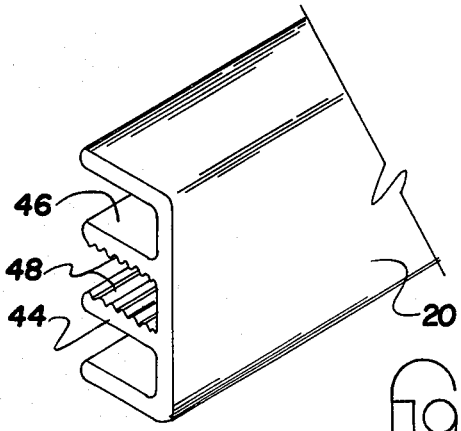
FIG. 4 shows a fragmented oblique projection of a hand rail member as used in association with the shower stall of FIGS. 1-2.

An elongated brace or support member 40 extends horizontally across the rear side of the panel 16 and is attached thereto and to the rear ends of the hand rail members 20 and 22 by means of threaded fasteners 42. The construction of the hand rails 20 and 22 of the present example being identical, only that of the member 20 need be explained. As shown in detail in FIG. 4, the hand rail 20 is a three-sided member containing a central pair of longitudinally extending flanges 44, 46. The central flanges 44, 46 contain irregular opposing surfaces having a plurality of longitudinally extending teeth 48 adapted to interleave with and securely grip the threads of the fasteners 24 (FIG. 1). As shown particularly in FIG. 3, the brace 40 is preferably constructed of an extruded aluminum alloy to form a member having U-shaped cross-section and longitudinally extending teeth 50 on opposing surfaces of the sides thereof for securely gripping the threads of the fasteners 42. (see FIG. 1).

Figure 2:
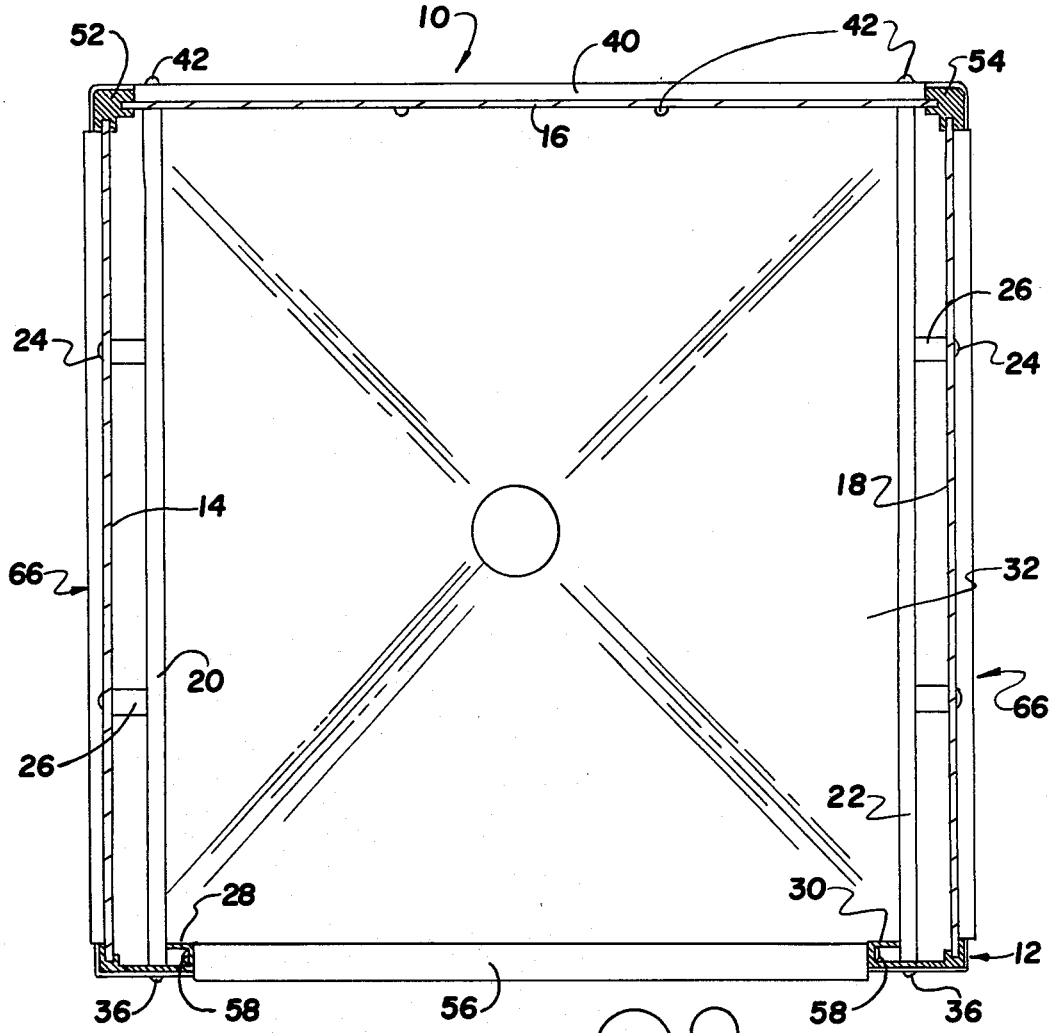
FIG. 2 shows a cross-sectional plan view of the shower stall of FIG. 1 as viewed along lines 2—2 of the latter figure.

A pair of vertically extending slotted clips 52 and 54 secure adjacent wall panels 14, 16 and 16, 18 together, respectively, to form rigid right angular rear corners. The clips 52 and 54 are conventional elements and may be formed of extruded aluminum or molded plastic. As seen most clearly in FIG. 2, the brace 40 is preferably closely confined between the clips 52 and 54. The drain base 12, also of a conventional type, is preferably a molded plastic unit but may also be constructed of aluminum or other material. A door sill 56, which may be constructed of aluminum, plastic or the like, is disposed just inside of the front rim of the base 12 and secured to lower end portions of the jambs 28 and 30 by means of threaded fasteners 58. The sill 56 defines the base of the frontal access opening to the interior of the stall 10 above which an optional door, not shown, may be swingably mounted between the jambs 28, 30.

The support frame 19 includes four aluminum angle members 60*a–d*, each of which is mitered on each end so as to join together to form right angular corners such as at the corner 62. Flat triangular plates 64 overlie and are riveted to adjacent ends of the members 60*a–d* to secure and reinforce the right angular corners 62 thus formed. An elongated tubular member 65, flattened on opposite ends, may be secured to the plates 64 on either side of the doorway to form a curtain rod from which a curtain, not shown, may be suspended just inward of the member 60*a*.

Figure 5:
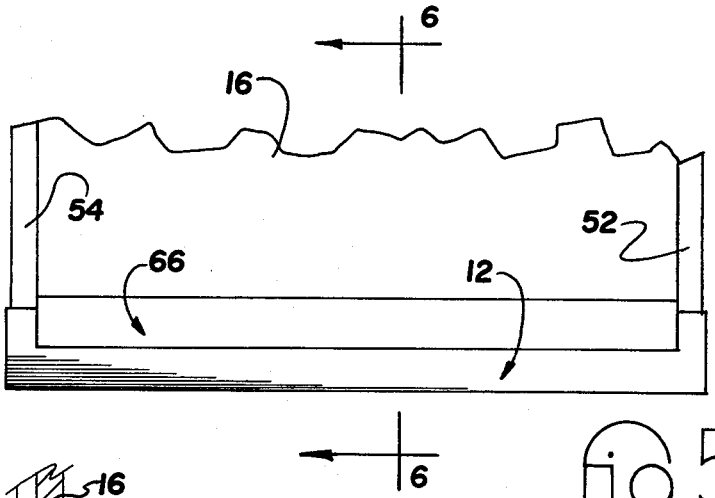
FIG. 5 shows a fragmented elevation view of a bottom portion of the rear side of the shower stall of FIGS. 1-2.
Figure 6:
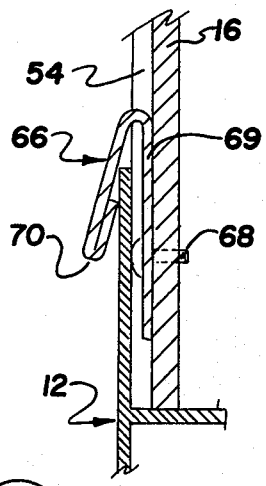
FIG. 6 shows a cross-sectional elevation view of the fragmented structure of FIG. 5 as viewed along lines 6—6 of the latter figure.
Figure 7:
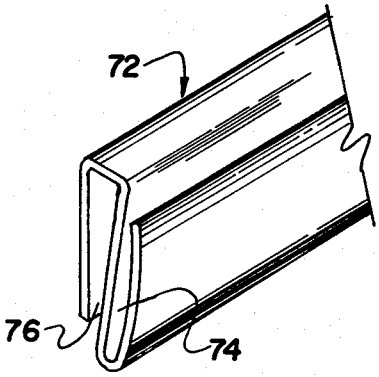
FIG. 7 shows a fragmented oblique projection of an alternative component adapted for use in association with the shower stall of FIGS. 1-2 and 5.

The lower ends of the panels 14–18 may be secured to elongated hook-like clips 66 by means of suitable threaded fasteners 68 (FIGS. 5–6). The panels 14–18 and vertical back portions 69 of the clips 66 are inserted inwardly of the rims of the base 12 so that a downwardly projecting hooked end 70 of the clips 66 overlaps the rims of the base 12, thus securing the lower end portions of the panels 14–18 to the rims of the base 12 uniformly around three sides thereof (See FIGS. 5–6). In the alternative, a series of elongated hooks 72 (FIG. 7) having an S-shaped cross-section may be employed in place of the clips 66 simply by inserting the lower edges of the wall panels 14–18 into the upwardly opening portions 74 and thereafter forcing the downward opening portions 76 over the rim of the base 12. The latter means for securing the lower end portions of the panels 14–18 to the rims of the base 12 will appear similar to the structure as viewed in FIG. 5 wherein the hook 72 replaces the clip 66 shown therein.

Figure 8:
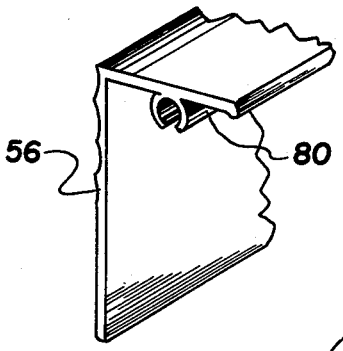
FIG. 8 shows a fragmented oblique projection of a door sill assembly as used in association with the shower stall of FIGS. 1-2.

The sill 56 may have a generally L-shaped cross-section (See FIG. 8). A cylindrically shaped tube 80 is formed along the underside of the horizontal lip of the sill into the ends of which the fasteners 58 are inserted.

The curtain rod 65 is secured to the plates 64 above the jambs 28, 30 so as to extend across the top of the doorway parallel to and inwardly of the inside edge of the front support member 60*a* to allow a curtain, not shown, to hang directly therefrom across the doorway just inside of the jambs 28, 30.

Although the subject invention has been described with respect to specific details of certain preferred embodiments thereof, such details are not intended to limit the scope of the subject invention except only to the extent set forth in the following claims.

I claim:

1. A shower stall comprising:

wall panels joined together to form a three-sided enclosure defining a rear wall, a pair of opposing side walls, a frontal access opening and two right angular rear corners, a pair of rigid elongated hand rail members separate and distinct from one another attached to and extending at least partially along opposing broad surfaces of said side walls within said enclosure, the rear ends of said members extending to and terminating against opposite side portions of said real wall, means for spacing said members from said opposing broad surfaces to permit hand gripping of said members by a person standing within said enclosure, and an elongated brace attached to and extending at least partially across the back of said rear wall outside of said enclosure between the rear ends of said members, opposite end portions of said brace being connected through opposite side portions of said rear wall to different ones of said members, whereby said separate and distinct hand rail members within said enclosure and said brace external to said enclosure interconnect and rigidify said wall panels.

2. The shower stall of claim 1 further comprising door jamb means connected to said side walls on either side of said access opening, said hand rail members extending into and connecting with said door jamb means.

3. The shower stall of claim 1 further comprising a pair of elongated corner clips extending vertically between and connected to adjacent vertical edge portions of said wall panels, said brace extending laterally across said rear wall between and in close fitting relationship with said corner clips.

4. The shower stall of claim 1 wherein each of said hand rail members comprises a three sided element, and a pair of flanges centrally disposed in said element and extending longitudinally therethrough, opposing surfaces of said flanges defining longitudinally extending teeth adapted to securely grip the threads of a fastener.

5. The shower stall of claim 1 further comprising a support frame.

6. The shower stall of claim 5 wherein said support frame comprises four angle members having mitered ends joined together to form right angular corners.

7. The shower stall of claim 6 further comprising flat triangular plates overlying and attached to the corners of said frame to secure said angle members together.

8. The shower stall of claim 1 further comprising a rectangular drain base defining a raised rectangular rim into which said wall panels are disposed.

9. The shower stall of claim 8 further comprising a series of elongated J-shaped hook-like clips, each of said clips having a vertical back portion and a hooked end, said back portion of each of said clips being connected to a lower end portion of a different one of said wall panels, each said hooked end opening downwardly and overlapping said rim to secure each of said wall panels to said base uniformly along the three sides of said enclosure.

10. The shower stall of claim 8 further comprising a series of elongated hooks having S-shaped cross-section defining an upwardly opening portion into which the lower ends of said wall panels are disposed and further defining downwardly opening portions overlapping the rim of said base for securing said wall panels to said base.

11. The shower stall of claim 1 wherein said brace comprises a three-sided element, opposing surfaces of which contain longitudinally extending teeth adapted to securely grip a threaded fastener.

12. The shower stall of claim 1 wherein said wall panels are constructed of a relatively flexible material.

13. The shower stall of claim 12 wherein said material is selected from the group consisting of plastic, fiberglass reinforced polyester resin, polypropylene, polyethylene, and ABS.

14. A shower stall comprising wall structure forming a three-sided enclosure and defining a rear wall, a pair of opposing side walls, two right angular rear corners, and a frontal access first means forming an elongated hand rail attached to and extending at least partially across only a single one of said side walls inside of said enclosure, second means forming an elongated hand rail attached to and extending at least partially across the other of said side walls only, inside of said enclosure, means for spacing said first and second means from said side walls to permit hand gripping of said first and second members by a person standing within said enclosure, and bracing means attached to the back of said rear wall outside of said enclosure and being attached through said rear wall to said first and second means, for interconnecting and rigidifying said wall structure.

* * * * *